United States Patent [19]

Savitt et al.

[11] 3,991,679

[45] Nov. 16, 1976

[54] BOOSTER APPARATUS FOR AUGMENTING SIDE INITIATION OF EXPLOSIVE CORDS

[75] Inventors: Jacob Savitt, Capitola; William Campbell Morgan, San Jose, both of Calif.

[73] Assignee: The United States of America as represented by the Secretary of the Navy, Washington, D.C.

[22] Filed: June 23, 1975

[21] Appl. No.: 589,482

[52] U.S. Cl. ..... 102/27 F; 102/24 HC

[51] Int. Cl.[2] ..... C06C 5/06

[58] Field of Search ..... 102/24 HC, 27 R, 27 I, 102/28, 29

[56] References Cited

UNITED STATES PATENTS

| | | | |
|---|---|---|---|
| 1,652,961 | 12/1927 | Snelling | 102/27 F |
| 2,605,704 | 8/1952 | Dumas | 102/24 HC |
| 3,129,663 | 4/1964 | Schnepfe, Jr. | 102/27 R |
| 3,212,439 | 10/1965 | Reyne | 102/28 |

*Primary Examiner*—Verlin R. Pendegrass
*Attorney, Agent, or Firm*—R. S. Sciascia; P. N. Critchlow

[57] ABSTRACT

A booster charge is provided with an arcuate, semi-cylindrical surface disposed in continuous contact with a length of explosive cord at a location medial of its length. A donor charge detonates the booster which, in turn, applies the detonation force to a side portion of the explosive cord to produce a cord detonation propagating axially in both directions. Reliability of the cord detonation is increased by the increased amount of the booster charge closely adjacent to the cord and by some focusing of the booster charge. The shock wave propagation in the cord is reliably augmented by the booster. The increased reliability factors permit miniaturization of the donor charge, the booster and the cord.

8 Claims, 3 Drawing Figures

BOOSTER APPARATUS FOR AUGMENTING SIDE INITIATION OF EXPLOSIVE CORDS

BACKGROUND OF THE INVENTION

The present invention relates to explosive cord technology and, in particular, to means for initiating cord detonation from a point medial the length of the cord.

There are many different types of explosive cords which vary in size, grain content, shielding, structural arrangements, materials, etc. and, of course, such cords are used for a variety of purposes. For example, aircraft and missile installations frequently employ lengths of the explosive cords to transport a shock wave initiated at a central location to a relatively large number of devices which are to be detonated automatically in some selected manner. Conventionally, the cords terminate in some sort of a booster arrangement which directly detonates the particular device or initiates the propellant to actuate the device.

However, there are some very real problems involved in the successful use of the cords especially when the particular installation may impose strict space limitations or may involve safety considerations which themselves dictate either the use of a limited quanity of explosive or, heavy protective arrangements to contain larger explosive forces. For these reasons, many arrangements attempt miniaturization by employing charges which are relatively mild or small consistent with the ever-present reliability requirement. For example, the art has developed the so-called MDC, MDF or LEDC types of cords the designations of which imply a mild detonating or a low energy detonating characteristic. Such cords, for example, might employ about one grain of PETN explosive mixture per foot and, physically considered, may be about 0.25 inch in diameter or less. In general, the effort has been one of reducing the cord size to what is known as a 'critical diameter' which can be achieved and reliably propagated throughout the cord length. This 'critical diameter', in turn, must be related to the donor charge of the cord detonator and, here again the effort has been one of minimizing the donor size and strength.

In most of the explosive cord applications, it has been found advantageous to apply the detonating force to the cord by means of a booster or the like which is coupled to one end of the cord. The end coupling is preferred since the major portion of the booster shockwave then is travelling axially of the cord so as not only to initiate cord propagation but also to maintain the propagation. Even so, as is readily apparent in the prior art, there has been considerable difficulty in maintaining the cord propagation especially, of course, when miniaturization is a factor. This problem then becomes even greater than there is a need or desire to apply the force of the donor charge in a direction that is radial to the cord, or, in other words, to initiate the cord from one of its sides at a point or site medial of its length. This need frequently arises because the installation design requires a change of direction of the propagation to the extent that, for example, the propagation involves a directional turn such as a 90° turn or one which reverses the direction back toward the source. Side initiation also is used when it is desired to produce a shock wave propagation axially of the cord in both directions simultaneously for the purpose of detonating devices located at each cord end.

Attempts to achieve such side initiation have met with rather limited success particularly when the milder detonations are required or, in other words, where there is an effort to approach the so-called 'critical diameter'. The obvious problem is that the major force of the donor detonator is travelling radially and, even if it succeeds in initiating the cord detonation, the resulting shockwave tends to die out rather than propagate through the entire cord length. The prior efforts mostly have involved the use of relatively large donor detonators which usually are disposed a slight distance or space from the cord, although at times these detonators are brought into direct contact with the cord. As indicated, the success or reliability of these side-initiated arrangements have depended somewhat upon the use of sufficiently large detonators which, of course, are not compatible with miniaturization. Even so, it has been found that arrangements in which such detonators are brought into direct contact have not demonstrated adequate reliability. The net result has been that, regardless of its advantages, the use of side initiation has been significantly limited particularly when miniaturization is desired.

A principal object of the present invention is to provide a means for accomplishing the side detonation of explosive cords in a reliable manner and in a manner which permits miniaturization of the donor and acceptor charges. As will be described, this object generally is achieved by employing a booster between a donor charge and the explosive cord, the booster having an arcuate surface that substantially continuously engages a major circumferential portion of the surface of the cord facing the booster.

BRIEF DESCRIPTION OF THE DRAWINGS

The present invention is illustrated in the accompanying drawings of which.

DETAILED DESCRIPTION OF THE INVENTION

Figure 1:
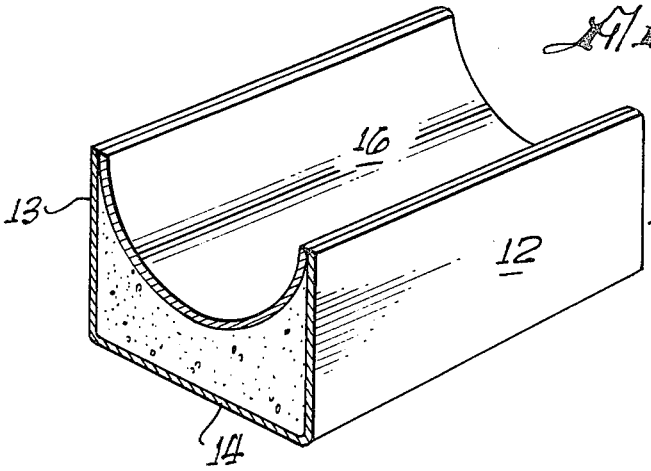
FIG. 1 is a sectional view showing the installed arrangement of the components.

As shown in FIG. 1, the various components include an 'end' fitting or detonator 1 which provides the donor charge, an explosive cord 2 and a specially-formed booster 3 disposed between the detonator and the cord. These components are fitted into an opening or bore 4 provided in a manifold housing 6 which, as will be appreciated, simply is intended to illustrate any body portion of the installation in which the system is deployed. It further should be noted that FIG. 1 is intended to represent a length of the explosive cord and that housing 6 normally would be provided with another bore or opening 7 extending transversely to opening 4 and bisecting opening 4 at the illustrated cross sectional region. In other words, explosive cord 2 is run through transverse opening 7 and the portion of the cord shown in FIG. 1 is a portion disposed medially of the ends of the cord length. Consequently, the arrangement is one which is used to initiate cord detonation from a side portion of the cord rather than from an end portion.

From an operational standpoint, the FIG. 1 arrangement is intended to depict an installation in which a remote control disposed on a control panel or the like initiates a detonating force which is transported and applied to donor charge or detonator 1. The resulting detonation of donor 1 initiates the detonation of booster 3 which, in turn, is applied to explosive cord 2. The booster force detonates explosive cord 2 and the resulting shockwave is propagated axially in both directions of the cord to its end portions. Other boosters used to detonate the main explosive charges or simply to continue the train of events to another desired location may be disposed at the ends of the cord length.

The components and explosive materials used in the illustrated arrangement may be widely varied to suit the particular conditions dictated by the installation. The donor charge may be any desired commercially-available detonator or end fitting of sufficient size to detonate booster 3. Obviously, for miniaturization purposes the detonator used will be the minimum size needed and, of course, the size will depend upon the other components that are used. However, one advantage of the present arrangement is that the detonator selection is not critical since it achieves reliability whether the detonator be a large or small one.

Explosive cord 2 also is a well-known, widely used component which, as shown, is formed of a central explosive core surrounded by a sheath 9 of aluminum or the like and by an outer protection cover 11. Further, the cord can be either shielded or unshielded and its size selected according to the particular function to be accomplished. However, when miniaturization is a factor the cord should approach the so-called 'critical diameter'. For example, mild detonating cords MDC, MDF and LEDC, then would be preferred and the size would be the minimum capable of reliably maintaining shockwave propagation when detonated by the particular geometry of the arrangement which, of course, includes the magnitude of the explosive charge of booster 3.

Figure 2:
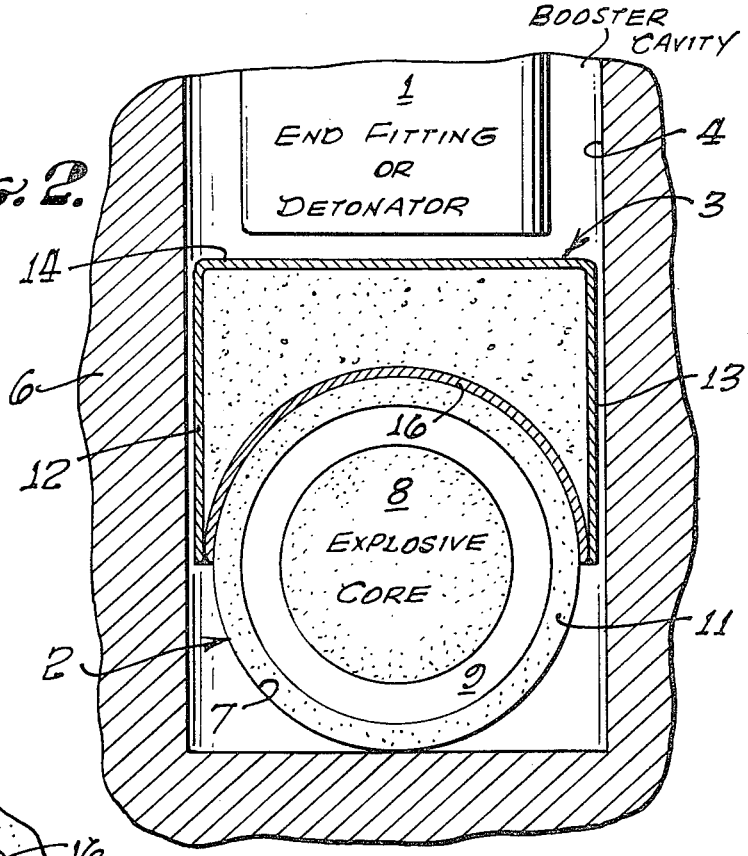
FIG. 2 is a perspective view of the booster used to accomplish side detonation.

A feature of the present invention is the use of specially-shaped booster 3. As shown in FIG. 2, booster 3 is an elongate, trough-like member formed by an aluminum or other metal or non-metal material container of adjustable wall thickness and a secondary or primary explosive material disposed within the container. Typical secondary explosive compounds such as PETN, RDX, HNS nad HMX may be employed to suit different conditions. Thus, PETN can be used to increase sensitivity or HNS employed in high temperature situations. Other primary explosives, such as Lead Azide, may be used if even greater sensitivity is desired. The container, as shown, is formed of sidewalls 12 and 13, outer wall 14 and an arcuately curved inner wall 16. The explosive material may be pressed, cast, molded or machined. Liquid or gaseous explosives may also be used. Wall 16 may be secured by welding or by adhesion after the container has been filled with the explosive. As shown in FIG. 1, the curvature of wall 16 has a radius dimensioned to closely fit about the periphery of cord 2. Thus, it provides a semicylindrical contacting surface for receiving the cord. If the cord has a triangular or other cross section the surface curvature may be suitably modified to fit.

Other dimensions of the container can be adjusted according to circumstances. For example, the height of sidewalls 12 can be varied to any desired height. Maximum height consistent with miniaturization is desired to provide maximum explosive force. The width represented by the dimension of outer wall 14 preferably is approximately equal to the diameter of the cord although again it may be significantly larger or smaller dependent upon output requirements and other limitations. As also shown, the angle between outer wall 14 and the sidewalls is approximately 90° and outer wall 14 preferably is a flat surface paralleling the end surface of detonator 1. Again, however, this particular angle may be significantly varied without appreciably affecting operation. The length dimension of sidewall 12 and 13 should be as large as practically can be provided to assure maximum effectiveness. Obviously, a relatively long container is capable of applying its detonating force to a relatively long section of cord 2. However, this length normally will be limited and, if so, maximum effectiveness can be increased by adding additional boosters. The greater this length the longer the distance the detonation in the cord is boosted.

As shown in FIG. 1, booster 3 is disposed with its arcuate, cup-shaped surface directly contacting about 180° of the explosive cord so that the explosive material of the booster surrounds this contacted portion and is closely adjacent to it. Detonator 1 is spaced a slight distance from flat outer wall 14 of the booster preferably to take advantage of the fragmentation of the detonator. The spacing, for example, may be about 10 mils. Functionally considered, detonation of the booster produces the detonation of cord 2 by focusing the explosive force of the booster toward the explosive core of the cord. The particular advantage of the arrangement is due to the fact that the explosive of the booster surrounds a major portion of the cord circumference and is immediately adjacent to the cord. This ability of the booster to detonate the cord is dependent upon two factors, the first being the increase of the amount of the explosive brought into close proximity to the cord and the second being the focusing action of the booster detonation force. However, as will be apparent, although some focusing is achieved, the booster design is not considered to be a so-called shaped charge design. Instead the principal concern is to increase the amount of explosive in close contact with the cord and, in doing so, to achieve a degree of focusing.

As has been indicated, side initiation of explosive cords previously has been achieved simply by using a detonator, such as detonator 1 disposed in contact with or at a spaced distance from the explosive cord. Usually, a gap is left between the end of the detonator and the cord or, at most, detonator and cord touch only at their point of tangency. It has been found that such detonator arrangements are not reliable unless a sufficiently large detonator is employed and/or a particular optimum gap is used. If the detonator is brought into direct contact with the cord, as has been attempted in some prior art arrangements, reliability is decreased in many cases. Thus, the present arrangement is one in which booster 3 is employed to fill the previous gap between the detonator and the cord and, in addition to filling the gap, it disposes its explosive in the shaped proximity to the cord. In addition, the booster can more reliably accept detonation from the donor. This arrangement reliably detonates the explosive cord and of equal importance, it augments the side initiation by maintaining the propagation of the shockwave along the cord length. In general, miniaturization is possible because of the increased effectiveness of the booster and its increased ability to be detonated by the donor. Also, because a relatively small booster can be used, detonator 1 can also be relatively small and the critical diameter of the explosive cord can be approached.

Figure 3:
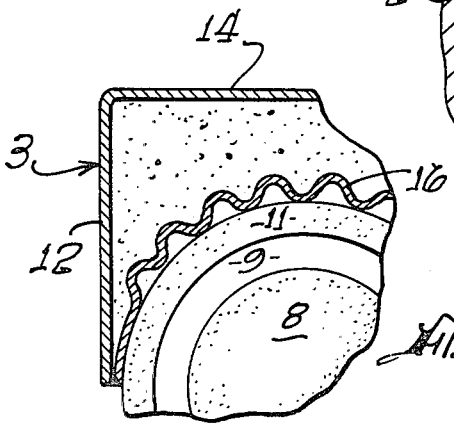
FIG. 3 is a view similar to FIG. 2 showing a modification in the booster design.

FIG. 3 illustrates a modified form of booster 3. As shown, the surface of inner wall 16 is fluted rather than being smooth. The fluted configuration improves the jet penetration of the booster. Use of the fluting is considered beneficial when the explosive cord is heavily shielded although, it also can be employed with other types of cords.

Obviously many modifications and variations of the present invention are possible in the light of the above teachings. It is therefore to be understood that within the scope of the appended claims the invention may be practiced otherwise than as specifically described.

I claim:

1. Apparatus for initiating the detonation of a continuous length of explosive cord at a site disposed medially of its length, comprising:

a manifold housing formed with a longitudinal opening having inner and outer end portions and with a second opening extending transversely of and intersecting said first opening, said cord length being run through said second opening, a donor charge disposed in the outer end portion of said first opening, and a booster charge disposed between said donor charge and said cord, said booster charge having an outer end wall disposed in close proximity with said donor charge and an inner end wall having an arcuate extent disposed in substantially continuous contact with a major peripheral extent of the outwardly-facing circumferential portion of said cord, said donor charge detonating said booster charge to focus its explosive force into said cord throughout said major peripherial extent.

2. The apparatus of claim 1 wherein said inner end wall is shaped for continuously contacting at least about 180° of said cord.

3. The apparatus of claim 2 wherein said donor charge is miniaturized to provide a detonating force near the minimum needed for producing a reliable cord detonation.

4. The apparatus of claim 3 wherein said explosive cord is a mild detonating cord, said charge being dimensioned to have a width approximately equal to the diameter of said cord and a length at least as great as said width.

5. The apparatus of claim 2 wherein the dimensions of said housing openings are reduced to a minimum needed for receiving and detonating a mild detonating cord.

6. The apparatus of claim 1 wherein said booster charge inner end wall is provided with a fluted contour for improving the jet penetration force of said charge.

7. The apparatus of claim 6 wherein said explosive cord is a shielded cord.

8. The apparatus of claim 6 wherein said cord is a shielded cord of a mild detonating cord type.

* * * * *